US006817909B2

(12) United States Patent
Dobrinski et al.

(10) Patent No.: US 6,817,909 B2
(45) Date of Patent: Nov. 16, 2004

(54) ELECTRICAL SPLICE CONNECTOR WITH SPRING

(75) Inventors: Daniel D. Dobrinski, Raymond, NH (US); Roger H. Hanks, Littleton, NH (US); Keith F. Mello, Manchester, NH (US); Daniel J. Stanton, New Lenox, IL (US)

(73) Assignee: FCI USA, Inc., Etters, PA (US)

( * ) Notice: Subject to any disclaimer, the term of this patent is extended or adjusted under 35 U.S.C. 154(b) by 313 days.

(21) Appl. No.: 09/794,611

(22) Filed: Feb. 27, 2001

(65) Prior Publication Data

US 2002/0173206 A1 Nov. 21, 2002

(51) Int. Cl.[7] ..... H01R 4/50
(52) U.S. Cl. ..... 439/783; 439/788
(58) Field of Search ..... 439/788, 786, 439/787, 783; 24/136 R

(56) References Cited

U.S. PATENT DOCUMENTS

| | | | | | |
|---|---|---|---|---|---|
| 3,071,831 | A | | 1/1963 | Chickvary et al. | 24/126 |
| 3,329,928 | A | | 7/1967 | Broske | 339/247 |
| 3,384,704 | A | | 5/1968 | Vockroth | 174/90 |
| 4,428,100 | A | * | 1/1984 | Apperson | 24/115 R |
| 4,451,104 | A | | 5/1984 | Hodgson et al. | 439/409 |
| 4,624,519 | A | * | 11/1986 | Lawrence | 439/410 |
| 4,634,205 | A | | 1/1987 | Gemra | 439/391 |
| 4,698,031 | A | | 10/1987 | Dawson | 439/863 |
| 4,752,252 | A | | 6/1988 | Cherry et al. | 439/784 |
| 5,539,961 | A | * | 7/1996 | DeFrance | 24/136 R |
| 5,683,273 | A | | 11/1997 | Garver et al. | 439/784 |
| 6,076,236 | A | * | 6/2000 | DeFrance | 24/136 R |
| 6,193,565 | B1 | * | 2/2001 | Herron | 439/783 |
| 6,206,736 | B1 | * | 3/2001 | DeFrance et al. | 439/796 |
| 6,390,861 | B1 | * | 5/2002 | DeFrance | 439/783 |
| 6,547,481 | B2 | * | 4/2003 | Grabenstetter et al. | 403/374.2 |

OTHER PUBLICATIONS

Malico Catalog; Anchor Clamps for Bare or insulated Messenger; p. 1.11.
Hubbel Fargo Catalog; Side Opening Wedge Dead End Installation Instructions.
Hubbel Fargo Catalog; Automatic, Full Tension Line Splices; p. 2–2.
"Connectors for Wire, Strand and Conductors", Reliable Power Products, Inc., pp. 3 and 7.

* cited by examiner

*Primary Examiner*—Renee Luebke
(74) *Attorney, Agent, or Firm*—Harrington & Smith, LLP

(57) ABSTRACT

An electrical splice connector comprising a frame, at least one set of cooperating wedge members movably mounted to the frame, and a first spring connected between a first one of the wedge members and the frame. The wedge members have opposing sides adapted to contact opposite sides of an electrical conductor. The spring extends at least partially along a length of the first wedge member.

23 Claims, 8 Drawing Sheets

ELECTRICAL SPLICE CONNECTOR WITH SPRING

BACKGROUND OF THE INVENTION

1. Field of the Invention

The present invention relates to electrical connectors and, more particularly, to a connector for splicing two conductors together.

2. Prior Art

U.S. Pat. No. 4,698,031 discloses a connector for ends of two conductors. The connector has two sets of jaws and springs biasing the jaws in opposite directions for automatically clamping onto an inserted conductor. There is a desire to provide a connector similar to that disclosed in U.S. Pat. No. 4,698,031, but which can have additional features such as a pre-latching feature for the jaws, an anti-reverse system for the jaws, or a spring system which can reduce the length of the connector.

SUMMARY OF THE INVENTION

In accordance with one embodiment of the present invention, an electrical splice connector is provided comprising a frame, at least one set of cooperating wedge members movably mounted to the frame, and a first spring connected between a first one of the wedge members and the frame. The wedge members have opposing sides adapted to contact opposite sides of an electrical conductor. The spring extends at least partially along a length of the first wedge member.

In accordance with another embodiment of the present invention, an electrical splice connector is provided comprising a frame having an open side for receiving ends of two oppositely extending electrical conductors through the open side; a first wedge movably connected to the frame along a first length of the frame; and a second wedge movably connected to the frame along a second length of the frame which is spaced from the first length. The end of a first one of the electrical conductors can be inserted through the open side of the frame and contact the first wedge. The end of a second one of the electrical conductors can be inserted through the same open side of the frame and contact the second wedge.

In accordance with another embodiment of the present invention, an electrical splice connector is provided comprising a frame having two ends with a conductor passage aperture in each end and a side between the two ends which has a conductor entrance aperture contiguous with the passage apertures; and a first set of cooperating wedge members movably mounted to the frame. Each wedge member is located and retained in a separate retaining groove of the frame. The wedge members have opposing surfaces adapted to contact opposite sides of an electrical conductor. The conductor is inserted through the entrance aperture and extends out of a first one of the end passage apertures. The wedge members of the first set directly contact each other to move with each other along the frame.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
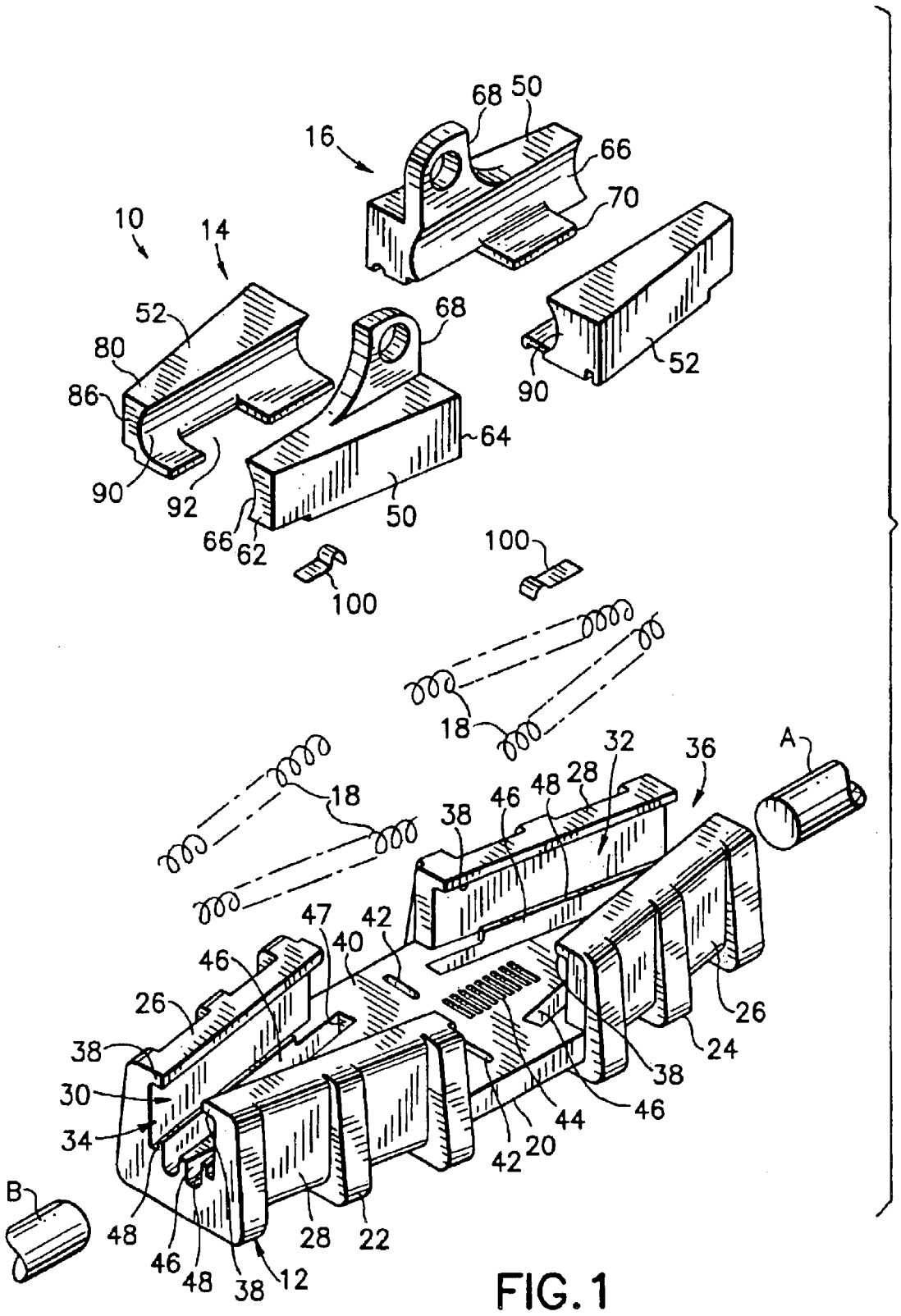
FIG. 1 is an exploded perspective view of a connector incorporating features of the present invention.

Referring to FIG. 1, there is shown an exploded perspective view of an electrical connector 10 incorporating features of the present invention intended to connect ends of two conductors A, B to each other. Although the present invention will be described with reference to the embodiments shown in the drawings, it should be understood that the present invention can be embodied in many alternate forms of embodiments. In addition, any suitable size, shape or type of elements or materials could be used.

Figure 2:
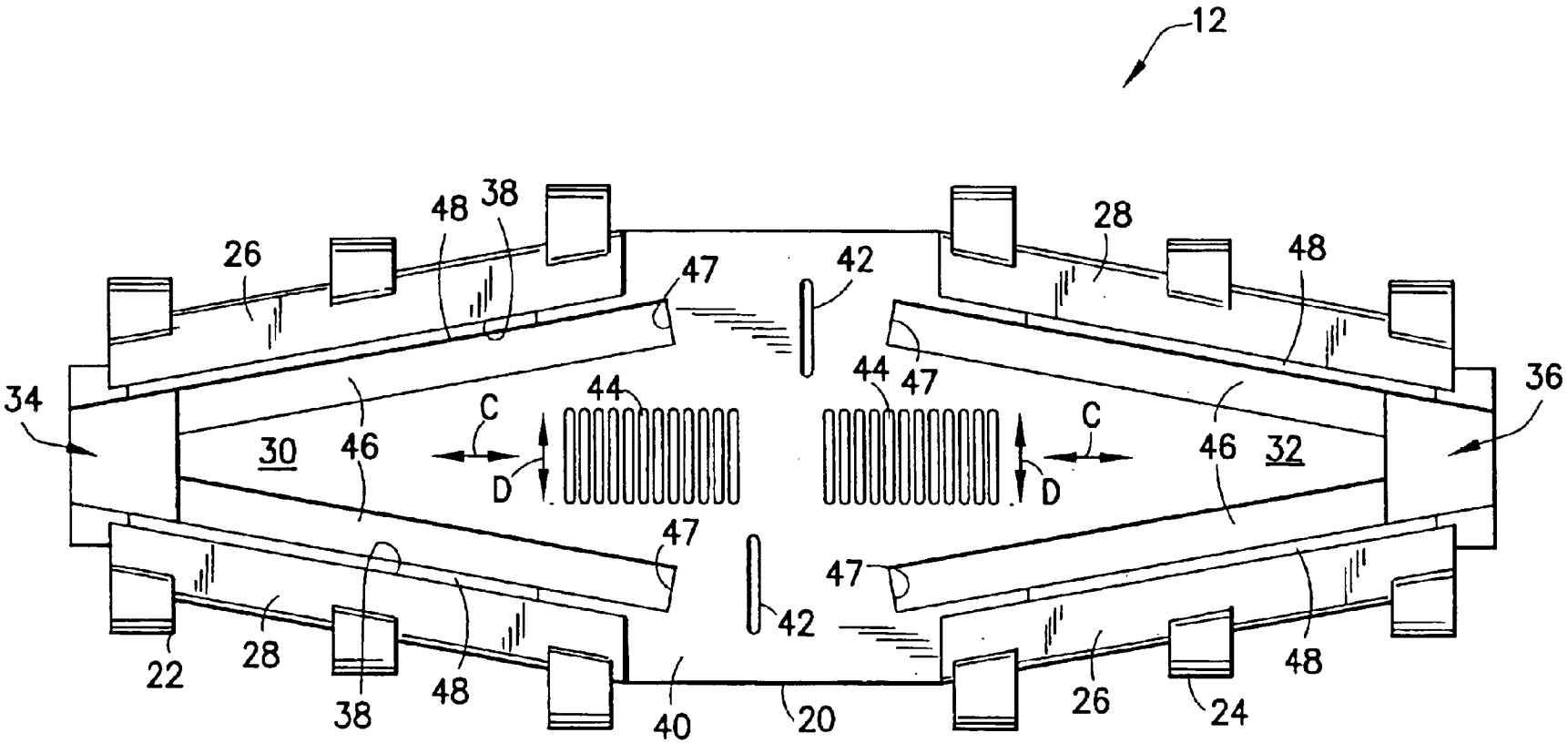
FIG. 2 is a top plan view of the frame of the connector shown in FIG. 1.

The connector 10 generally comprises a frame 12, a first wedge 14, a second wedge 16, and springs 18. In alternate embodiments less features or additional features could be provided. Referring also to FIG. 2, the frame 12 is preferably a one-piece metal member, such as a cast metal member. However, the frame could be comprised of more than one member, could be comprised of any suitable material(s), and/or could be made by any suitable manufacturing process. The frame 12 generally comprises a middle section 20 and two sections 22, 24 connected to each other by the middle section 20. The two sections 22, 24 are substantially mirror images of each other. However, in alternate embodiments they could be different. Each section 22, 24 has opposite side walls 26, 28 which are angled relative to each other to form wedge shaped receiving areas 30, 32. The frame 12 can have stiffening ribs to strengthen the wedge sections 22, 24. The frame 12 has a substantially open top side which extends into the receiving areas 30, 32. The opposite ends of the frame 12 have conductor passage apertures 34, 36 into the receiving areas 30, 32. In this embodiment the middle section 20 is open on three sides. The tops of the side walls 26, 28 include inwardly extending retaining lips 38. In this embodiment, one side 40 of the frame forms a common side for all three sections 20, 22, 24.

At the middle section 20, the side 40 includes two latching bosses or projections 42 and two series of serrations or grooves 44. The side 40 also includes spring grooves 46 and guide rails or projections 48. In alternate embodiments the frame could have more or less features, the features could be arranged in any suitable manner on the frame, and/or the features could have any suitable size or shape.

Figure 3:
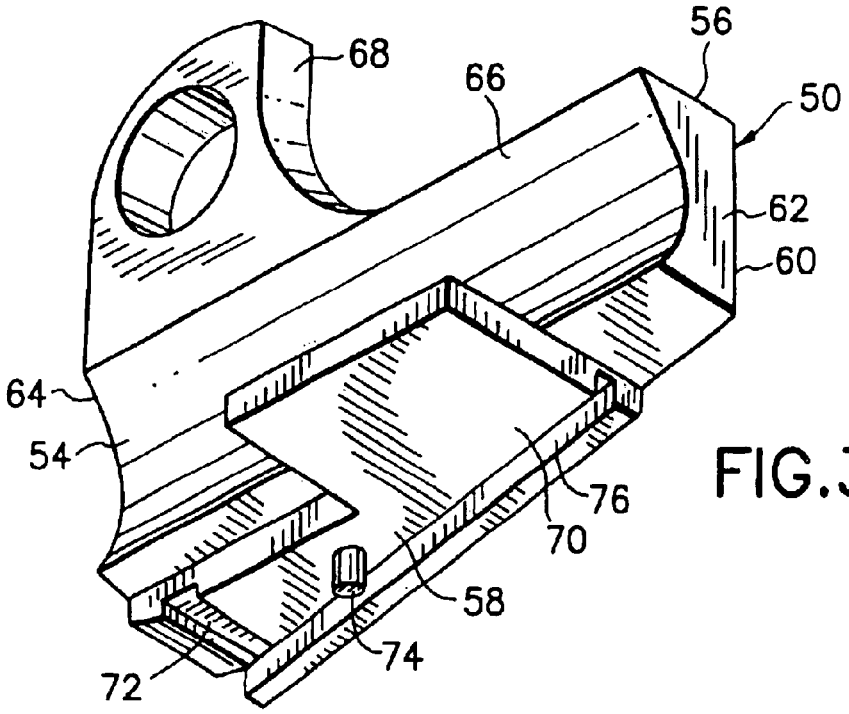
FIG. 3 is a bottom, front, inside perspective view of one of the wedge members shown in FIG. 1.
Figure 4:
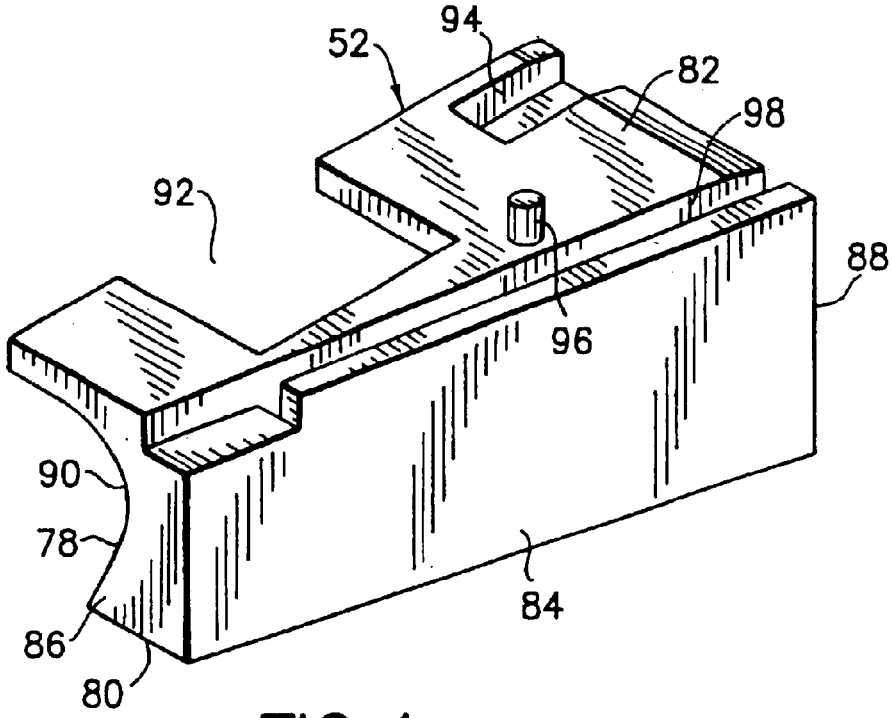
FIG. 4 is a bottom, front, outside perspective view of another one of the wedge members shown in FIG. 1.

The two wedges 14,16 are substantially the same, but merely orientated in reverse orientations relative to each other. However, in alternate embodiments more or less than two wedges could be provided, and the wedges could have different shapes. Referring also to FIGS. 3 and 4, in this embodiment each wedge has two wedge members 50 and 52. However, in alternate embodiments each wedge could have more or less than two wedge members. The first wedge member 50 is preferably a one-piece cast metal member. However, in alternate embodiments the first wedge member 50 could be comprised of multiple members, could be comprised of any suitable material(s), and/or could be manufactured by any suitable process.

The first wedge member 50 generally comprises four sides 54, 56, 58, 60 located between a front end 62 and a rear end 64. The inner side 54 has a curved conductor contact surface 66. The inner side 54, proximate the bottom side 58, also comprises a wedge member interlock projection 70. The top side 56 has a finger contact section 68 adapted to allow a finger of a user to move the first wedge member. However, in an alternate embodiment the finger contact section might not be provided, or any suitable type of section for direct interaction with the user could be provided. The thickness of the first wedge member 50 between the two lateral sides 54 and 60 increases from the front end 62 to the rear end 64 to form a general wedge shape. The bottom side 58 generally comprises a latching recess 72, a spring contacting section 74, and a groove 76.

The sides 60 of the first wedge members 50 are located against the inner surfaces of the sides 28 of the frame 12. The bottom sides 58 are located against the side 40 of the frame 12 with the spring contacting section 74 extending into respective ones of the spring grooves 46. One of the guide projections 48 extends into each of the grooves 76. The retaining lips 38 of the sides 28 extend over a portion of the top sides 56 of the first wedge members.

The second wedge member 52 is preferably a one-piece cast metal member. However, in alternate embodiments the second wedge member 52 could be comprised of multiple members, could be comprised of any suitable materials(s), and/or could be manufactured by any suitable process. The second wedge member 52 generally comprises four sides 78, 80, 82, 84 located between a front end 86 and a rear end 88. The inner side 78 has a curved conductor contact surface 90. The inner side 78, along the bottom side 82, also comprises a wedge member interlock recess 92. The thickness of the second wedge member 52 between the two sides 78 and 84 increases from the front end 86 to the rear end 88 to form a general wedge shape. The bottom side 82 generally comprises a recess 94, a spring contacting section 96, and a groove 98.

Figure 5:
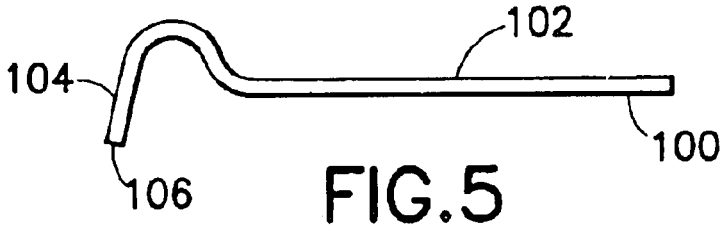
FIG. 5 is a side elevational view of one of the spring clips show in FIG. 1.

The second wedge members 52 are located against the inner surfaces of the sides 26 of the frame 12. The bottom sides 82 are located against the side 40 of the frame 12 with the spring contacting section 96 extending into respective ones of the spring grooves 46. Respective ones of the guide projections 48 extend into the grooves 98. The retaining lips 38 of the sides 26 extend over a portion of the top sides 80. In the embodiment shown, the second wedge members 52 also each comprise a clip 100 (see FIG. 5). The clip 100 has a mounting section 102 and a latch section 104. The clip 100 could be comprised of sheet metal or any other suitable material. The mounting section 102 is fixedly attached to the second wedge member 52 in the recess 94 by any suitable means. The tips 106 of the latch section 104 extend in a downward direction from the bottom side 82 of each second wedge member. However, in alternate embodiments the clip 100 might not be provided, or could be attached to the first wedge members, or could have any suitable shape, or could be formed integrally with the second wedge member.

The springs 18, in the embodiment shown, are coil springs, but any suitable springs could be provided. In this embodiment a spring 18 is provided for each wedge member 50, 52. However, in alternate embodiments more or less springs could be provided, such as one spring for each pair of wedge members 50, 52. The springs 18 in this embodiment are intended to be compression springs. The springs 18 are located in respective ones of the spring grooves 46. One end of each spring 18 is located against the inward closed end 47 of its respective groove 46. The opposite end of each spring is located against one of the spring contact sections 74, 96. In the embodiment shown the spring contact sections 74, 96 merely comprise projecting bosses. However, in alternate embodiments any suitable type of spring contact sections could be provided. The compression springs 18 exert forces on the wedge members 50, 52 to bias the wedges 14, 16 towards the ends of the frame 12. The wedge spring mechanism is a feature that causes the wedges to put an initial force on the conductor during the insertion. The force is such that it maintains enough friction between the wedges and the conductor such that, as the conductor is pulled during installation, it allows the wedges to "set" without the conductor slipping through the wedges. In one embodiment the connector utilizes a compression spring for each wedge to develop the force. In another embodiment the connector utilizes an extension spring for each wedge to develop the force. The wedges have interlocking fingers that prevent one wedge advancing at a different rate than the other. In both embodiments the grooves for the springs are in the base of the body of the connector opposed to the sides of the body of the connector. This allows the wedges to be designed such that the maximum surface of the wedge is in contact with the sides of the body of the connector. This permits the greatest surface contact for electrical conduction between the wedges and the body of the connector. The orientation of the grooves and springs also makes the need for additional sheet metal components unnecessary.

As noted above, the wedge members 50, 52 comprise an interlock projection 70 and an interlock recess 92, respectively. The projection 70 of the wedge member 50 extends into the recess 92 of the opposite wedge member 52 for each wedge 14, 16. This interlocks the pairs of wedge members 50, 52 to each other to move together in directions C relative to the longitudinal axis of the receiving areas 30, 32 and frame 12. However, the pairs of wedge members 50, 52 for each wedge 14, 16 are able to move or slide relative to each other in directions D, transverse to directions C, while still being interlocked with each other. In alternate embodiments any suitable type of movable interlocking engagement between pairs of wedge members could be provided, or no interlocking engagement could be provided.

Figure 6:
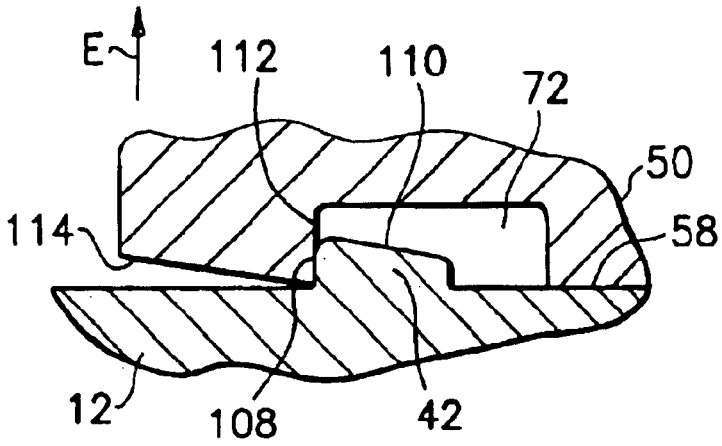
FIG. 6 is a partial cross-sectional view of the pre-latching system of the connector shown in FIG. 1.

The embodiment shown in FIG. 1 includes a latch system comprising the latching bosses 42 and the latching recesses 72. However, in alternate embodiments the connector might not have a latching system, or any suitable type of system for latching or retaining the wedges in rearward positions could be provided. Referring also to FIG. 6, the bosses 42 and recesses 72 are suitably sized and shaped relative to each other, and the bosses 42 are suitably orientated at the rear of the path of the first wedge members 50, such that the bosses 42 can extend into the recesses 72 when the first wedge members 50 are in rearward retracted positions on the frame 12; i.e.: located at middle section 20. Each boss 42 has a rear latching surface 108 and a ramp surface 110. Each first wedge member 50 has a latch surface 112 in the rear of the recess 72 and a ramp surface 114 behind the recess 72 on the bottom side 58. When the latching surfaces 108, 112 contact each other, the first wedge member 50 is latched to the frame 12 at its rearward position and, even though its spring 18 exerts a biasing force against the first wedge members 50, is prevented from moving forward towards one of the ends of the frame. Because of the interlock between pairs of the wedge members 50, 52, the associated opposite second wedge member 52 is also prevented from moving forward even though its spring exerts a biasing force against it. The ramp surfaces 110 and 114 allow the first wedge member 50 to be more easily moved onto the boss 42. The finger contact sections 68 of the first wedge members 50 allow the wedges to be more easily moved by the user to the rearward positions, such as by clamping the two finger contact sections 68 in a single hand, between thumb and forefinger, and squeezing. The finger contact sections 68 also provide a convenient location for a user to grasp the first wedge member 50 and lift its rear end up, as indicated by arrow E in FIG. 6, to disengage the two latching surfaces 108, 112 from each other and allow the springs 18 to move the wedge members 50, 52 on the frame 12 towards the ends of the frame and towards the conductor clamping positions for the wedges 14, 16. The pre-latching feature keeps the jaws open for ease of conductor insertion during installation. In one embodiment a small recess in the underside of one of the wedges (wedge which has finger tab) and a small boss in the surface of the connector body accomplish this. When the wedges are retracted to insert the conductor the boss engages with the recess in the bottom of the wedge keeping the wedges open temporarily. To close the wedges, the finger tab on the wedge is lifted up causing the recess to disengage from the boss.

Figure 7:
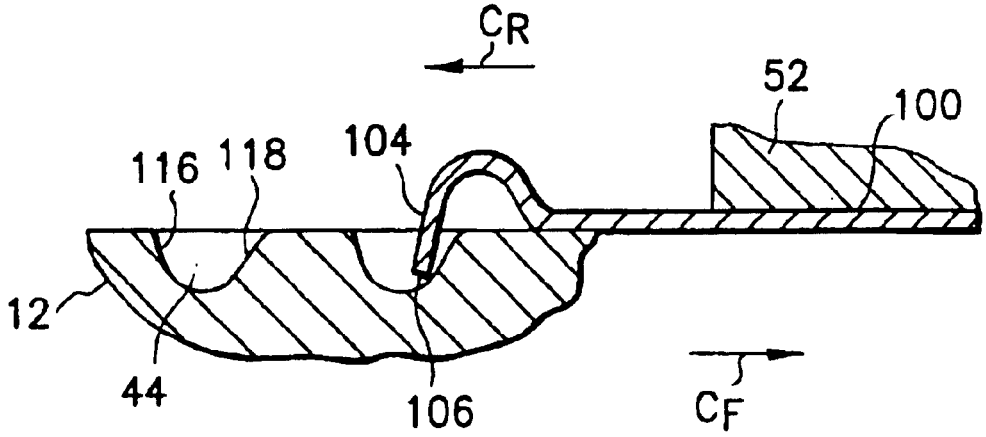
FIG. 7 is a partial cross-sectional view of the anti-reversing feature of the connector shown in FIG. 1.

The embodiment shown in FIG. 1 includes an anti-reverse feature comprising the serrations 44 on the frame 12 and the clips 100 on the second wedge members 52. However, in alternate embodiments the connector might not have an anti-reverse feature, or any suitable type of anti-reverse feature for preventing the wedges 14, 16, once moved towards their conductor clamping positions could be provided, from moving back towards their retracted positions. Referring also to FIG. 7, the serrations 44 preferably comprise a rear surface 116 having a steep slope and a front surface 118 having a more shallow slope. The tips 106 of the latch section 104 of the clips 100 can extend into the serrations. Because of the shallow slope of the front surfaces 118 of the serrations 44, the latching sections 104 can relatively easily resiliently deflect out of the serrations (one at a time) as the second wedge members 52 are moved forward in direction $C_F$ on the frame 12; towards their respective frame ends. However, if the second wedge member 52 is attempted to be moved in a reverse reward direction $C_R$, the steep slope of the rear surface 116 and shape of the latch section 104 combine to block such rearward movement. This helps to insure that once the wedges 14, 16 clamp onto a conductor, they stay attached even if subjected to vibrations or temporary subsequent push-in of the conductor A or B. The anti-reverse feature prevents the wedges from disengaging from the conductor once the wedges are set on the conductor. One embodiment utilizes a strip spring attached to the underside of one of the wedges and a series or serrations on the connector body surface. As the wedge tightens onto the conductor, the strip spring progressively "clicks" into each successive serration. The serrations are designed such that they allow the spring to advance to the next serration as the wedges tighten around the conductor. This is accomplished by the geometry of the edges of the serrations. The edge of the serration that leads to the next serration as the wedge advances is angled. This allows the spring to freely disengage and then engage with the next serration. The edge of the serration adjacent to the previous serration is perpendicular to the body of the connector. This prevents the spring from disengaging and retracting to the previous serration. Thus, the spring 100 is free to advance forward to the next serration, but cannot go back to the previous serration.

Once the connector 10 is assembled, its use is relatively simple. The wedges 14, 16 are maintained in their rearward pre-connection positions by the latch system 42, 72. The conductor A is inserted in receiving area 32 between the opposite conductor contact surfaces 66, 90 of the wedge members 50, 52. The conductor A can be inserted through the open top side of the frame 12 or through the end aperture 36. In either event, the conductor A extends out of the end aperture 36. The user then lifts the rear end of the first wedge member 50 by means of the finger contact section 68 to disengage the latch system 42, 72. The springs 18 automatically push the wedge members towards the end of the frame; towards the end aperture 36. The slide paths of the wedge members 50, 52 are angled relative to each other such that the wedge members 50, 52 move towards each other as they approach the end aperture 36. The surfaces 66, 90 move into contact with opposite sides of the conductor A and clamp onto the conductor. Thus, the wedge 16 connects the conductor A to the frame 12. The user can then pull on the conductor to more securely wedge the wedge members 50, 52 and conductor with each other in the wedge shaped receiving area 32. The wedge 14 can operate in a similar fashion to connect the conductor B to the frame 12. Thus, the connector 10 can electrically and mechanically connect the conductors A, B to each other. For each wedge, because of the interlocking nature of the pair of wedge members 50, 52, they can simultaneously move together to clamp onto the conductors. The embodiment shown in FIG. 1 provides a relatively open frame which allows a user to actively see if the conductors A, B are fully inserted and if the wedge members 50, 52 move properly to clamp onto the conductors. The ends of the conductors A, B can be located along a common axis. However, the location of the springs 18 offset from the paths of the wedge members 50, 52 and axes of the conductors allows the frame 12 to have a shorter longitudinal length than conventional designs. However, in alternate embodiments the conductors might not have a common axis and the spring(s) might not be offset. The guide rails 48 and guide grooves 76, 98 help to insure proper spreading and closing of the wedge members relative to each other. The surfaces 66, 90 could have teeth to project or bit into the conductors.

Figure 8:
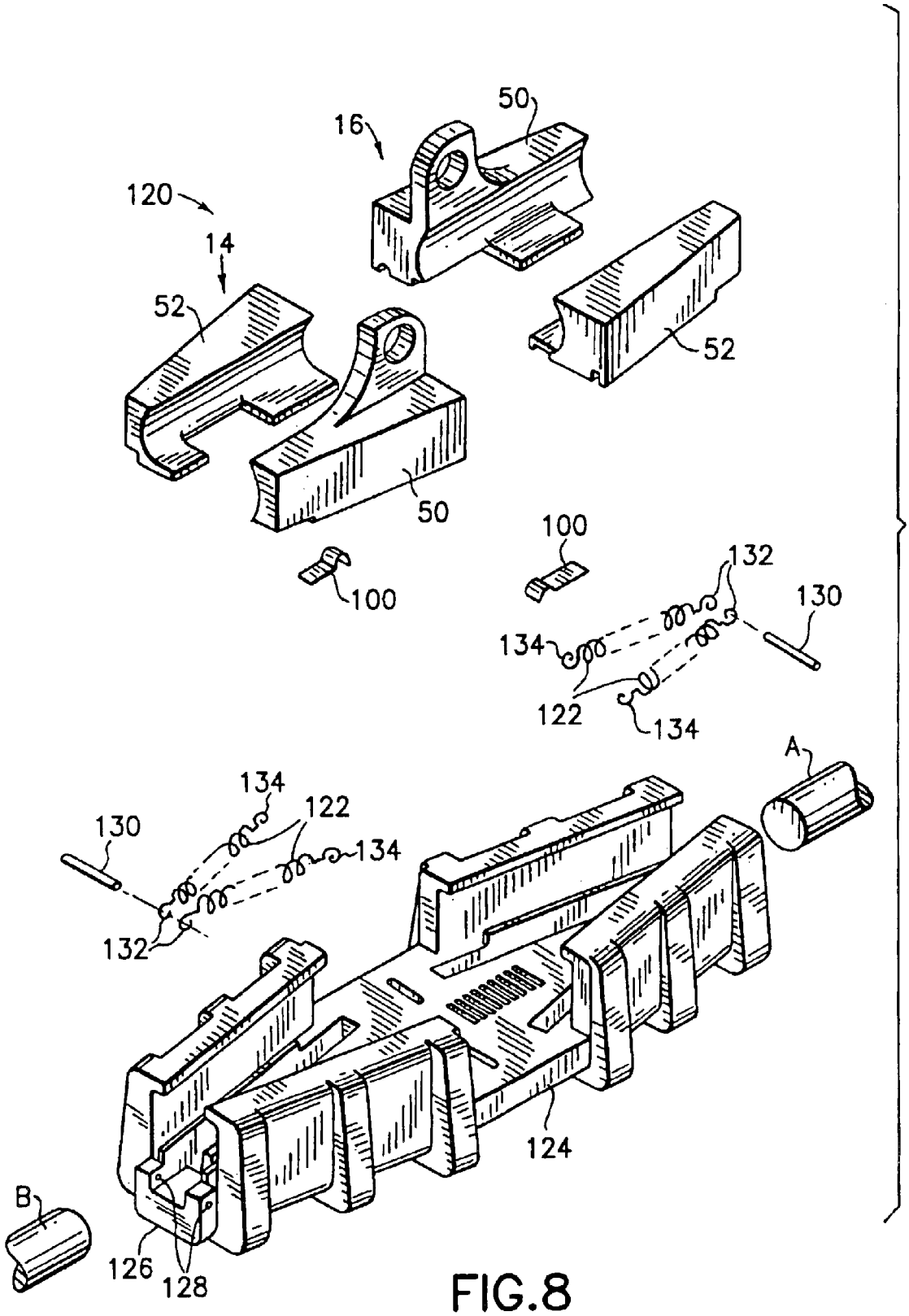
FIG. 8 is an exploded perspective view of an alternate embodiment of a connector incorporating features of the present invention.

Referring now to FIG. 8 an exploded perspective view of an alternate embodiment is shown. In this embodiment the connector 120 is very similar to the connector 10. However, the springs 122 are tension springs rather than compression springs. The frame 124 has extensions 126 at its opposite ends with pin holes 128. Pins 130 are located in the pin holes 128 and first loops 132 at first ends of the springs 122 are mounted on the pins 130. Second loops 134 at opposite second ends of the springs 122 are mounted on the posts 74, 96 (see FIGS. 3 and 4) of the wedge members 50, 52. The springs 122 can exert a tension biasing force on the wedge members of the wedges 14, 16 to move the wedges towards clamping positions against the respective conductors A, B.

Figure 10:
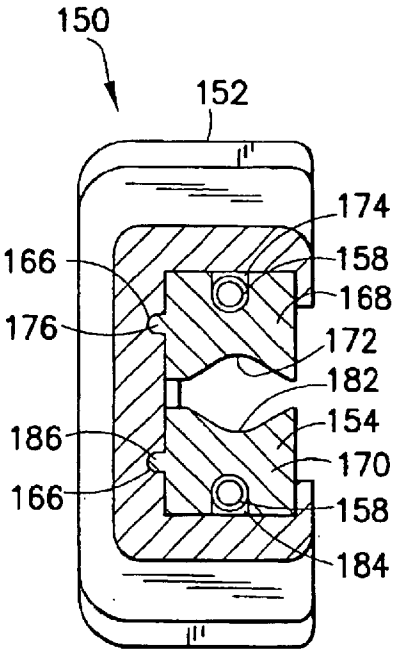
FIG. 10 is a cross-sectional view of the connector shown in FIG. 9 taken along line 10—10.
Figure 9:
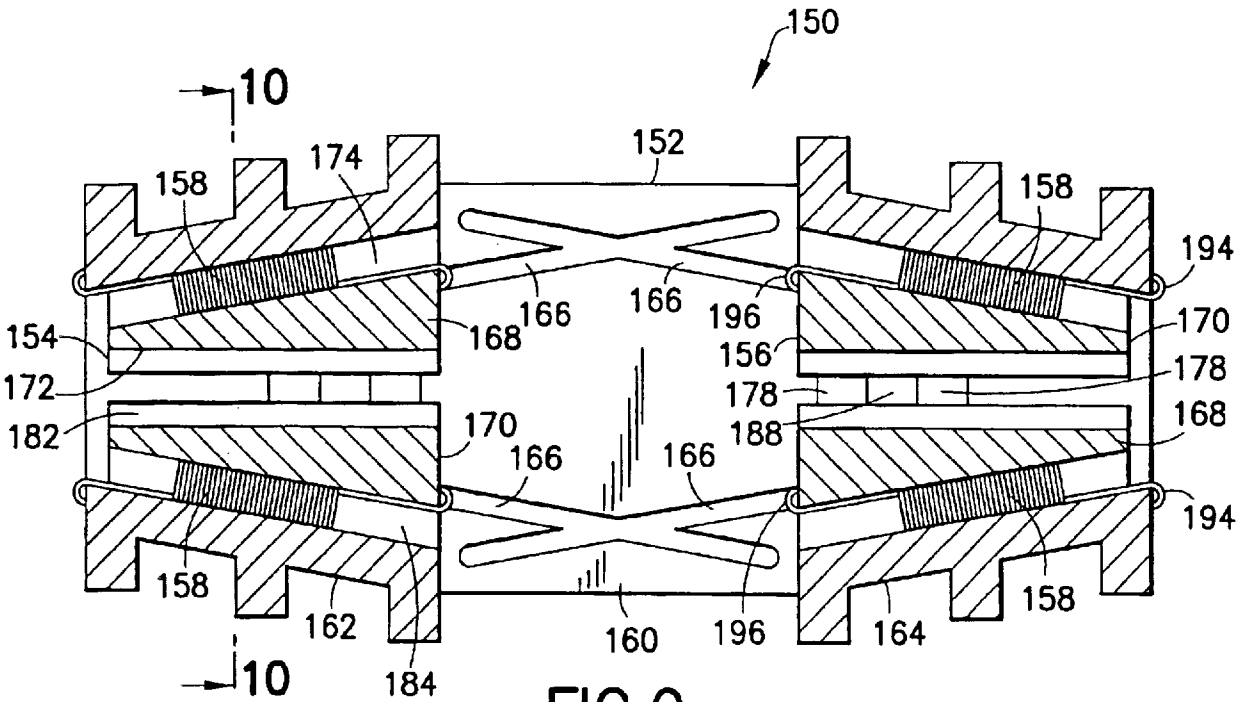
FIG. 9 is a schematic cross-sectional view of another alternate embodiment of a connector incorporating features of the present invention.
Figure 11A:
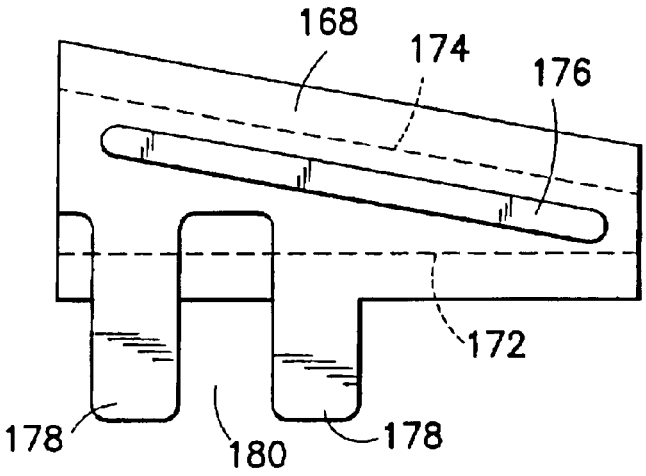
FIG. 11A is a bottom plan view of one of the wedge members shown in FIG. 9.
Figure 11B:
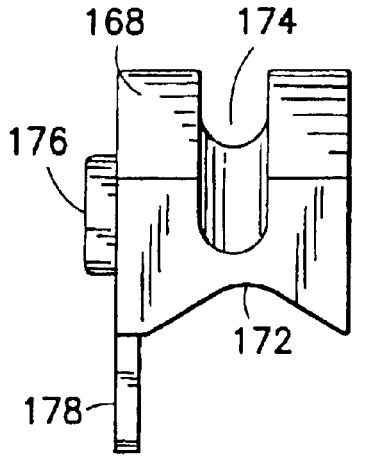
FIG. 11B is a front side elevational view of the wedge member shown in FIG. 11A.
Figure 11C:
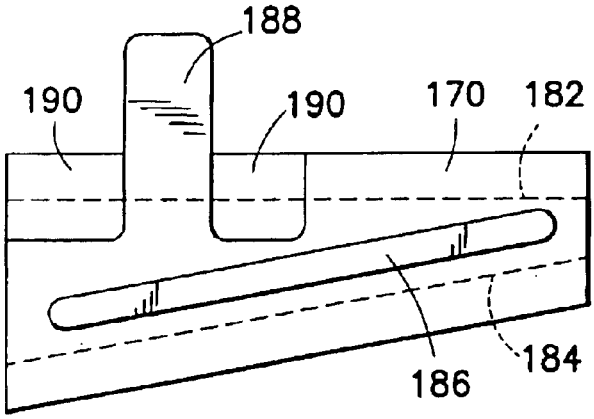
FIG. 11C is a bottom plan view of another one of the wedge members shown in FIG. 9.

Referring now to FIGS. 9 and 10 another alternate embodiment will be described. The connector 150 includes a frame 152, two wedges 154, 156 and tension springs 158. The frame 152 has an open center section 160 and two wedge sections 162, 164 similar to the sections 22, 24 shown in FIG. 1. However, the frame 152 does not have spring grooves 46 or guide rails 48. Instead, the frame 152 has guide grooves 166 which cross each other at the center section 160. However, in alternate embodiments the grooves 166 might not cross or intersect each other. Referring also to FIGS. 11A–11C, the wedge members 168, 170 of the wedges 154, 156 are shown. The first wedge member 168 comprises an inner side with a conductor contact surface 172, an outer side with a spring groove 174, a bottom side with a guide rail or projection 176, and two inward projections 178 with a guide slot 180 between the inward projections. The second wedge member 170 comprises an inner side with a conductor contact surface 182, an outer side with a spring groove 184, a bottom side with a guide rail or projection 186, an inward projection 188, and recesses 190 on opposite sides of the inward projection 188. Guide rails 176, 186 are located in the guide grooves 166 to guide movement of the wedge members 154, 156 on the frame 152. Inward projections 178 extend into recesses 190 and inward projection 188 extends into recess 180 such that the wedge members of each wedge can slide laterally inward and outward relative to each other, but are interlocked to move with each other in transverse directions. The springs 158 are located in the spring grooves 174, 184 of the wedge members. The springs 158 have ends 194, 196 clipped onto the wedge members and frame 152 such that the springs bias the wedges 154, 156 towards the opposite ends of the frame. The crossing nature of the grooves 166 allow increased range of movement for the wedge members. The paths of the wedges 154, 156 overlap at center section 160 for alternate positioning at center section 152. The increase range of movement can provide wider gaps between the conductor contact surfaces 172, 182 for larger conductors or easier location of the conductors between the surfaces 172, 182. The size of the frame can be smaller with this embodiment because of the increased range of movement for the wedges, the overlapping paths of the wedges 154, 156, and the springs extending in grooves of the wedges rather than spring grooves of the frame.

Figure 12A:
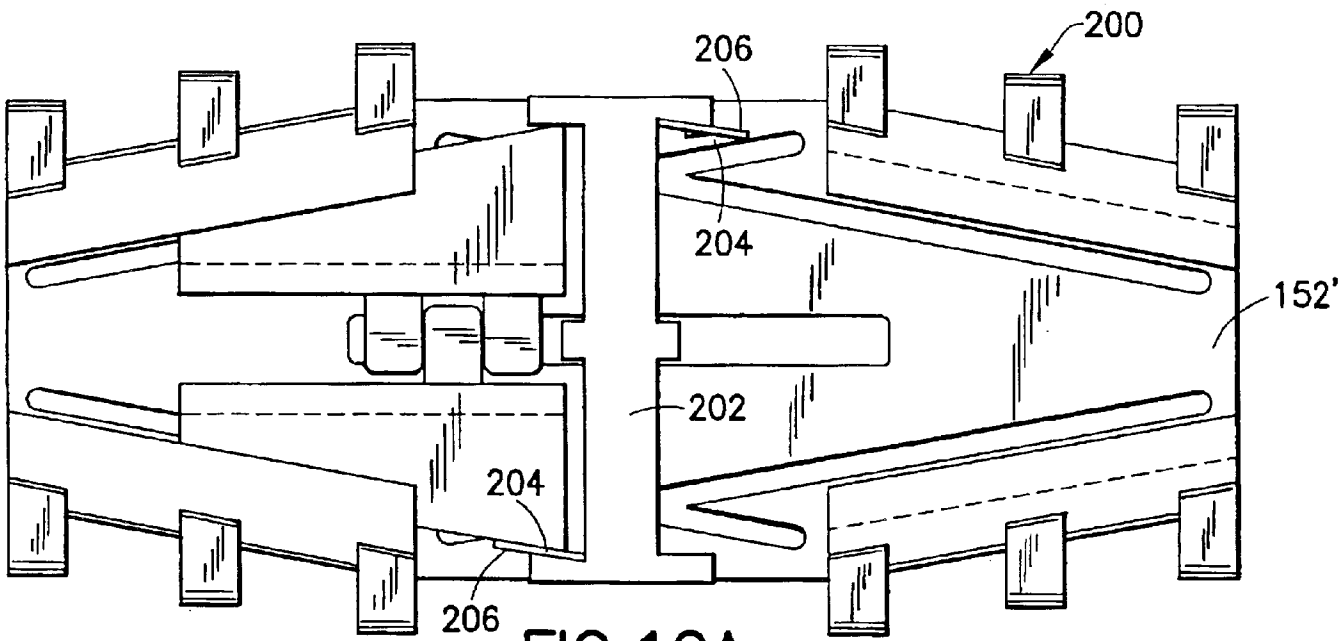
FIG. 12A is a top plan view of another embodiment of the present invention.
Figure 12B:
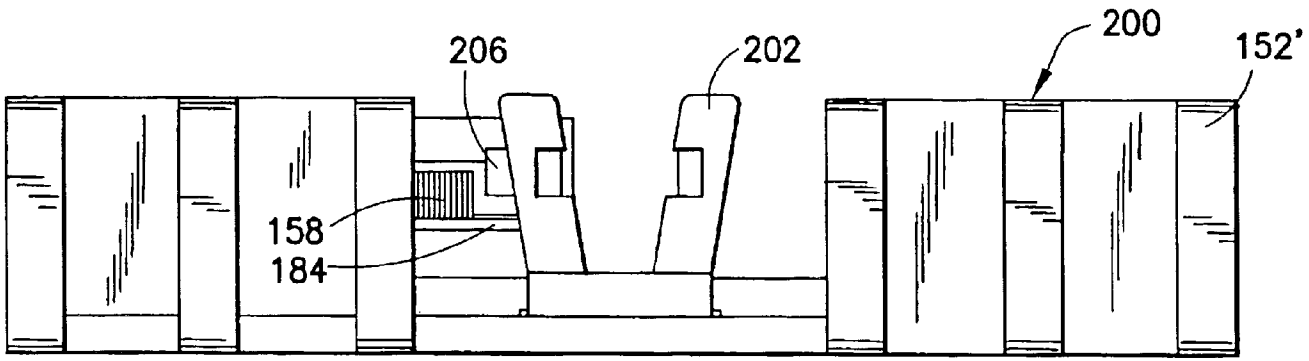
FIG. 12B is a side elevational view of the embodiment shown in FIG. 12A.

Referring now to FIGS. 12A and 12B, another alternate embodiment is shown. In this embodiment the connector 200 is substantially identical to the connector 150 shown in FIG. 9, but the frame 152' includes a pre-latch 202. The pre-latch 202 includes latch tabs 204. The tabs 204 are adapted to latch onto the second wedge members 170 to keep the wedges 154 and 156 (not shown in FIGS. 12A and 12B) in retracted pre-connection positions. A user can unlatch the tabs 204 from the second wedge members by merely pulling or deflecting the ends 206 outward.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical splice connector comprising:

a frame;

at least two sets of cooperating one-piece wedge members movably mounted to the frame, the wedge members of a first one of the sets having opposing sides adapted to contact opposite sides of an electrical conductor; and a first spring connected directly between a first one of the wedge members of the first set and the frame, the spring extending at least partially along a length of the first wedge member, wherein the wedge members of the first set directly contact each other.

2. A connector as in claim 1 further comprising a second spring connected between a second one of the wedge members of the first set and the frame.

3. A connector as in claim 1 wherein the wedge members of the first set are directly interlocked with each other to move with each other in a first direction, and can move relative to each other in a second direction.

4. A connector as in claim 1 wherein one of the one-piece wedge members of the first set comprises a finger contact section.

5. A connector as in claim 1 wherein the frame and at least one of the one-piece wedge members of the first set comprise a latch system for retaining the at least one wedge member at a retracted position for providing an enlarged area between the wedge members of the first set for insertion of the electrical conductor.

6. A connector as in claim 1 wherein the frame comprises a spring groove recessed along a surface of the frame, the surface being contacted by one of the wedge members of the first set, and wherein a majority of the spring is located in the spring groove.

7. A connector as in claim 1 wherein the two sets of wedge members are arranged on the frame as substantial reverse mirror images of each other.

8. A connector as in claim 1 wherein the frame comprises a substantially open side for receiving ends of two oppositely extending electrical conductors through the open side, and apertures through ends of the frame for the conductors to extend out of the frame.

9. A connector as in claim 1 wherein the frame comprises two ends with conductor passage apertures in each end and a side between the two ends which has a conductor entrance aperture.

10. A connector as in claim 1 wherein the spring is tension loaded between the first wedge member and the frame.

11. An electrical splice connector comprising:

a frame;

at least two sets of cooperating wedge members movably mounted to the frame, the wedge members of a first one of the sets having opposing sides adapted to contact opposite sides of an electrical conductor; wherein the frame and at least one of the wedge members of the first set comprise a latch system for retaining the at least one wedge member at a retracted position for providing an enlarged area between the wedge members of the first set for insertion of the electrical conductor; wherein the latch system comprises a projecting boss on the frame and a cooperating recess in the at least one wedge member; and a first spring connected between a first one of the wedge members of the first set and the frame, the spring extending at least partially along a length of the first wedge member and being loaded in tension.

12. An electrical splice connector comprising:

a frame;

at least one set of cooperating one-piece wedge members movably mounted to the frame, the wedge members having opposing sides adapted to contact opposite sides of an electrical conductor; a first spring connected directly between a first one of the wedge members and the frame, the spring extending at least partially along a length of the first wedge member; and an anti-reverse feature between the frame and at least one of the wedge members for preventing the at least one wedge member from moving in a predetermined direction on the frame and allowing movement in an opposite direction.

13. An electrical splice connector comprising:

a frame;

at least one set of cooperating wedge members movably mounted to the frame, the wedge members having opposing sides adapted to contact opposite sides of an electrical conductor; further comprising an anti-reverse feature between the frame and at least one of the wedge members for preventing the at least one wedge member from moving in a predetermined direction on the frame and allowing movement in an opposite direction; wherein the anti-reverse feature comprises a clip connected to the at least one wedge member and the frame comprising cooperating serrations; and a first spring connected between a first one of the wedge members and the frame, the spring extending at least partially along a length of the first wedge member.

14. A An electrical splice connector comprising:

a frame;

at least one set of cooperating one-piece wedge members movably mounted to the frame, the wedge members having opposing sides adapted to contact opposite sides of an electrical conductor; and a first spring connected directly between a first one of the wedge members and the frame, the spring extending at least partially along a length of the first wedge member, wherein the frame comprises a guide groove and at least one of the wedges comprises a projection which extends into the guide groove.

15. An electrical splice connector comprising:

a frame having an open side for receiving ends of two oppositely extending electrical conductors through the open side;

a first wedge comprising a one-piece first wedge member comprising an interlock projection and a one-piece second wedge member comprising an interlock recess wherein the projection and the recess cause the first and second members to interlock with each other, the first wedge movably connected to the frame along a first length of the frame; and a second wedge movably connected to the frame along a second length of the frame which is spaced from the first length, wherein the end of a first one of the electrical conductors can be inserted through the open side of the frame and contact the one-piece first and second wedge members of the first wedge, and the end of a second one of the electrical conductors can be inserted through the same open side of the frame and contact the second wedge.

16. A connector as in claim 15 wherein the frame comprises apertures through two ends of the frame which are contiguous with the open side.

17. A connector as in claim 16 wherein the frame comprises two oppositely orientated generally wedge shaped receiving areas respectively ending at the apertures through the two ends, and wherein the open side extends into both of the receiving areas.

18. A connector as in claim wherein the frame at each receiving area comprises a general "C" shaped cross-section.

19. A connector as in claim 15 wherein the frame comprises a spring groove along a surface of the frame, the surface being contacted by the first wedge, and the connector further comprises a spring located in the spring groove which is connected between the frame and first wedge.

20. A connector as in claim 15 wherein the first wedge member and the second wedge member comprise opposing conductor contact surfaces.

21. A connector as in claim 15 wherein the frame comprises a guide groove and the first wedge comprises a projection located in the guide groove and slidable along the guide groove.

22. An electrical splice connector comprising:

a one-piece frame member having two ends with a conductor passage aperture in each end and a side between the two ends which has a conductor entrance aperture contiguous with the passage apertures; and a first set of cooperating one-piece wedge members movably mounted to the frame member, wherein each wedge member is located and retained in a separate retaining groove of the frame member, wherein the wedge members have opposing surfaces adapted to contact opposite sides of an electrical conductor, the conductor being inserted through the entrance aperture and extending out of a first one of the end passage apertures, and wherein the wedge members of the first set directly contact each other to move with each other along the frame member.

23. A connector as in claim 22 further comprising a second set of cooperating wedge members movably mounted to the frame member, wherein each wedge member of the second set is located and retained in a separate retaining groove of the frame member, wherein the wedge members of the second set have opposing surfaces adapted to contact opposite sides of another electrical conductor which has been inserted through the entrance aperture and which extends out of a second one of the end passage apertures, and wherein the wedge members of the second set directly contact each other to move with each other along the frame member.

* * * * *